US006832921B1

(12) United States Patent
Stewart

(10) Patent No.: US 6,832,921 B1
(45) Date of Patent: Dec. 21, 2004

(54) ELECTRICAL SAFETY OUTLET AND POWER CORD

(76) Inventor: Darren Stewart, 5000 Sundance Cir., Anchorage, AK (US) 99507

( * ) Notice: Subject to any disclaimer, the term of this patent is extended or adjusted under 35 U.S.C. 154(b) by 0 days.

(21) Appl. No.: 10/770,313

(22) Filed: Feb. 2, 2004

(51) Int. Cl.[7] ..... H01R 13/44
(52) U.S. Cl. ..... 439/134; 439/148; 174/66
(58) Field of Search ..... 439/134–135, 439/148–149, 357–358, 373; 174/66–67

(56) References Cited

U.S. PATENT DOCUMENTS

| | | | | | |
|---|---|---|---|---|---|
| 2,439,708 | A | * | 4/1948 | Abraham | 200/50.1 |
| 2,932,811 | A | * | 4/1960 | Abraham et al. | 439/148 |
| 3,955,870 | A | * | 5/1976 | Wasserman | 439/144 |
| 4,293,173 | A | * | 10/1981 | Tricca | 439/148 |
| 4,484,185 | A | * | 11/1984 | Graves | 340/656 |
| 4,895,527 | A | * | 1/1990 | Brown et al. | 439/147 |
| 5,285,014 | A | * | 2/1994 | Gilchrist | 174/67 |
| 5,299,099 | A | * | 3/1994 | Archambault | 361/837 |
| 5,314,347 | A | * | 5/1994 | Colleran et al. | 439/350 |
| 5,320,542 | A | * | 6/1994 | Cheng | 439/148 |
| D360,878 | S | * | 8/1995 | Dyer et al. | D13/156 |
| 5,454,729 | A | * | 10/1995 | Wen-Te | 439/357 |
| 5,525,755 | A | * | 6/1996 | Christensen | 174/67 |
| D383,727 | S | * | 9/1997 | Caruso et al. | D13/156 |
| 5,989,052 | A | * | 11/1999 | Fields et al. | 439/373 |
| 6,664,471 | B1 | * | 12/2003 | Howe, Jr. | 174/66 |
| 6,674,003 | B1 | * | 1/2004 | Torres | 174/66 |

* cited by examiner

*Primary Examiner*—Michael C. Zarroli
(74) *Attorney, Agent, or Firm*—Michael J. Tavella

(57) ABSTRACT

A removable cap that has two safety prongs. A replacement outlet cover is also provided that has corresponding side slots to receive the safety clips. When the cap is inserted into the outlet, the safety prongs engage the side slots, which then hold the cap in place. Once the safety prongs are engaged, the removable cap must be compressed to remove the cap. This type of action is beyond the motor skills of small children, thus making the caps totally safe for use around children. Moreover, removing the caps is a simple task for adults, which makes them more likely to be used than more complicated covers and locks. The caps can be sold as a kit with a replacement outlet box cover for a low price. Power cords can also be made with the safety prongs to prevent them from being easily pulled out of outlets.

5 Claims, 6 Drawing Sheets

ELECTRICAL SAFETY OUTLET AND POWER CORD

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates electrical safety outlets and particularly to electrical safety outlets having lockable covers.

2. Description of the Prior Art

Electrical outlets are common fixtures in homes today. Despite a number of safety improvements, these outlets remain a danger to small children. FIG. 1 shows a standard modern electrical outlet 100 as prior art. The slot openings 101 in the outlet that connect to the interior wiring are inviting to children who are driven to investigate everything. Every year children are electrocuted when they insert objects into the slots of electrical outlets.

To protect them from such danger, large covers have been invented. These covers fit over the entire outlet and can be locked. While making the outlet safe, they also make the outlet difficult to use. The cover must be unlocked every time the outlet is needed. Moreover, these covers extend out into the room, making furniture placement sometimes difficult.

Another device commonly used today is a small plastic cover 102, shown in fig. The cover 102 has prongs 103 that engage the slot openings in the outlet. When in place, these covers completely prevent access to the outlet slots; yet, they are easily removable when access to the outlet is needed. Moreover, because they are relatively flat, they do not block furniture placement. Despite these advantages, they have one major drawback. A determined child can pull them out of the outlet because there is nothing holding them in place. As a result, they improve safety only marginally.

BRIEF DESCRIPTION OF THE INVENTION

The instant invention overcomes these problems. It is a removable cap that has two safe prongs. A replacement outlet cover is also provided that has corresponding side slots to receive the safety prongs. When the cap is inserted into the outlet, the safety prongs engage the side slots, which then hold the cap in place. Once the safety prongs are engaged, the safety prongs must be compressed to remove the cap. This type of action is beyond the motor skills of small children, thus making the caps totally safe for use around children. Moreover, removing the caps is a simple task for adults, which makes them more likely to be used than more complicated covers and locks. Finally, the caps can be sold as a kit with a replacement outlet box cover for a low price. This makes them affordable as well as easy to install and use.

DETAILED DESCRIPTION OF THE INVENTION

Figure 3:
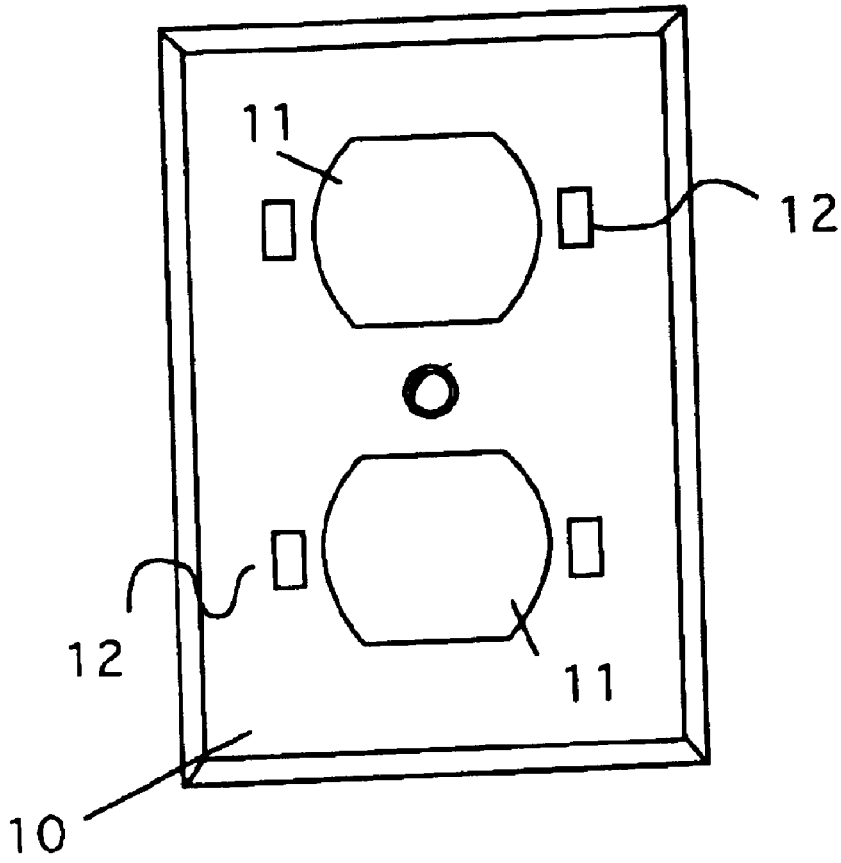
FIG. 3 is a front view of a replacement outlet cover, modified to accept the new safety cover.
Figure 4:
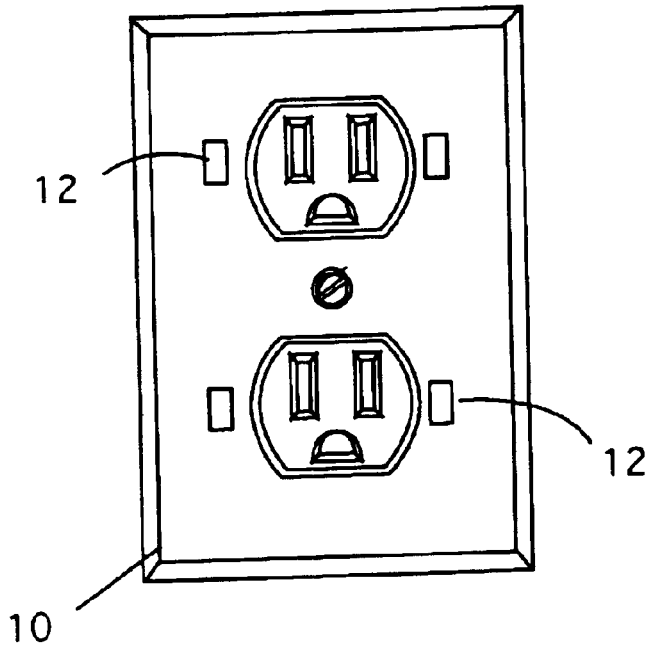
FIG. 4 is a front view of a replacement outlet cover, modified to accept the new safety cover installed on a receptacle.

FIG. 3 is a front view of a replacement outlet cover 10, modified to accept the new removable cap 20 which form the components of my safety cover system. The replacement cover is similar to the standard outlet cover in that it has two openings 11 for the receptacle. Unlike the standard outlet cover, the replacement cover 10 has one addition: on the space adjacent to the openings 11 for the receptacle are two slots 12. These slots are located on both the top and bottom of the replacement cover as shown. FIG. 4 shows the cover 10 installed on a receptacle. As shown, the cover 10 is the same size and shape as a standard outlet cover so that there is no problem in making the replacement.

Figure 1:
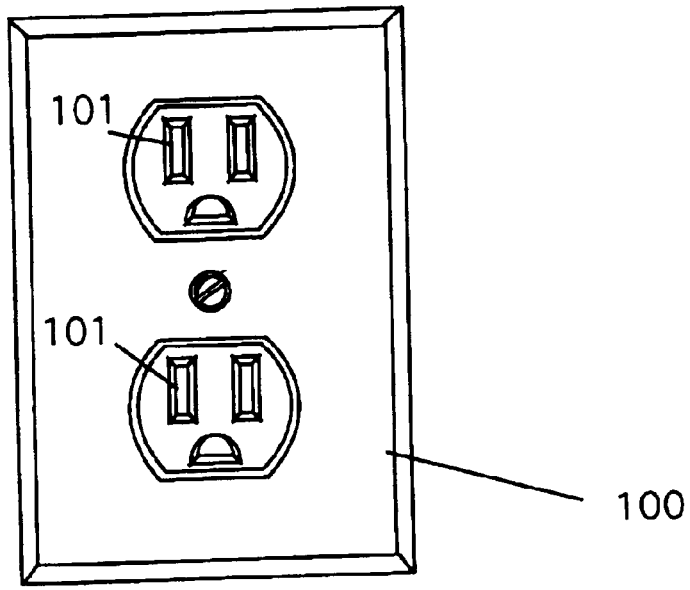
Figure 1 Prior Art
FIG. 1 is a front view of an outlet cover installed on a receptacle as prior art.
Figure 2:
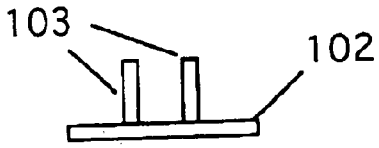
Figure 2 Prior Art
FIG. 2 is a top view of a safety cover as prior art.
Figure 5:
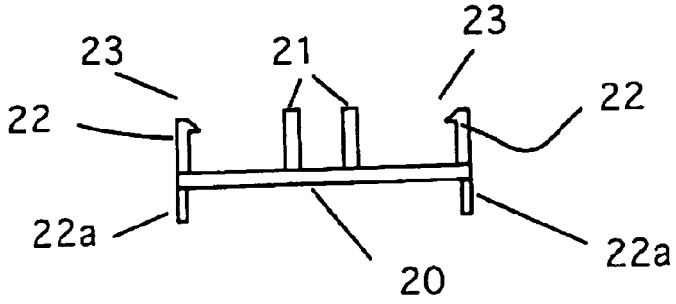
FIG. 5 is a top view of the removable cap.

FIG. 5 is a top view of the removable cap 20. The removable cap has two prongs 21 like the cover shown in FIG. 2. In addition, the removable cap 20 has two additional prongs 22 that align with the slots 12. Note that the prongs 22 have hooked ends 23. These hooked ends pass through the slots 12 and engage the back of the replacement cover (see e.g. FIG. 5). In this way, the outer prongs 22 prevent a child from simply pulling the removable cap out of the receptacle. A user must first push the prongs 22 slightly apart, by pushing in on the ribs 22*a*, so the hooked ends 23 pass through the slots 12 before the removable cap can be removed.

Note that the ribs 22*a* do not protrude excessively. This makes the removable cap completely safe for use around small children, yet the benefits of the flat safety cover are retained.

Figure 6:
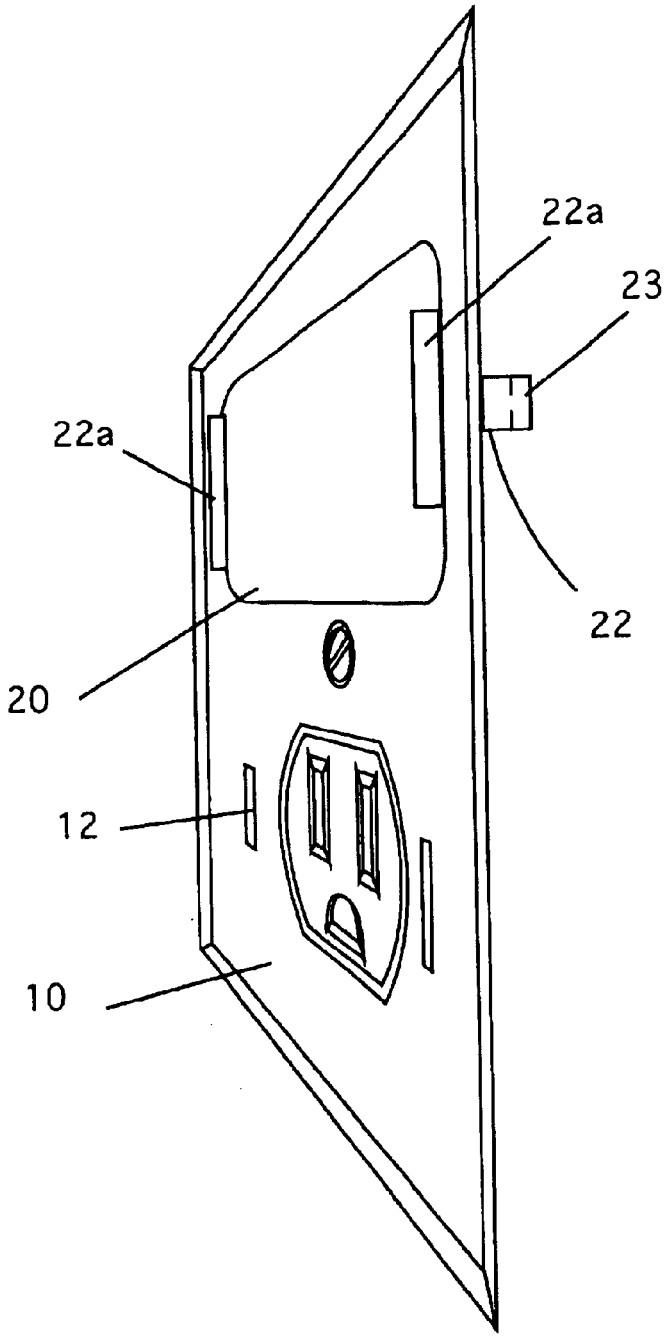
FIG. 6 is a perspective view of the replacement outlet cover with a removable cap installed, showing a side clip engaging a side slot.

FIG. 6 is a perspective view of the replacement outlet cover with a safety cover installed, showing a side clip engaging a side slot. As shown in this figure, the hooked end 23 of the prong 22 is shown on the back side of the replacement cover. In this figure, the ribs 22*a* are clearly shown.

Figure 7:
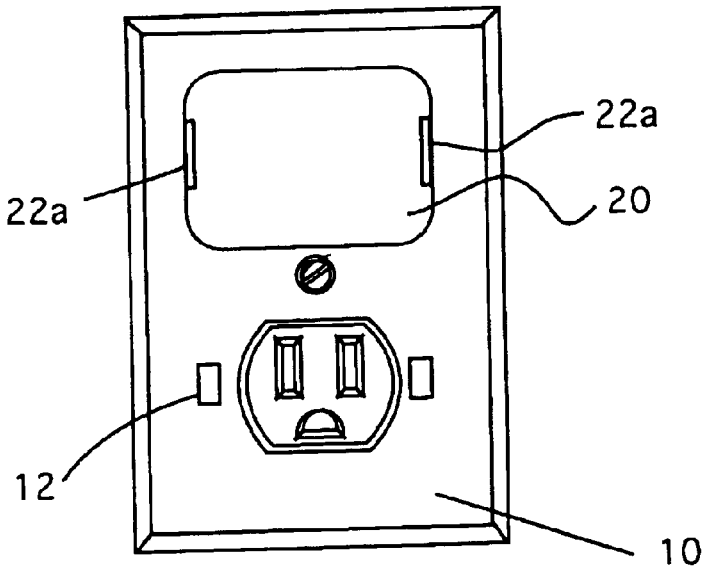
FIG. 7 is a front view of the removable cap installed in the replacement outlet cover.

FIG. 7 is a front view of the removable cap 20 installed in the replacement outlet cover 10. Here, the entire receptacle is covered. In the view, only one removable cap is shown.

Figure 8:
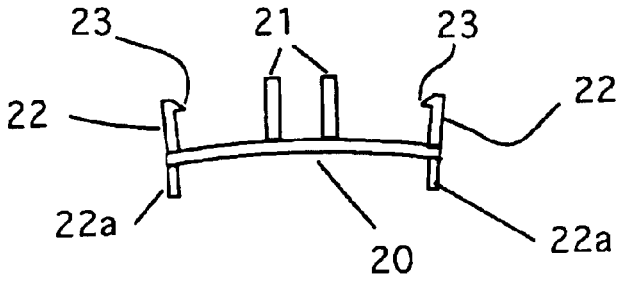
FIG. 8 is a detail top view of the removable cap showing the cap in the position for extraction.

FIG. 8 is a detail top view of the removable cap showing the cap in the position for extraction. Here, the removable cap 20 is shown bent back (the figure is slightly exaggerated for clarity). As the cap is bent back the prongs 22 bend as well. In this way, the prong ends 23 align with the slots 12 in the cover 10 so that the removable cap 20 can be easily removed.

Figure 9:
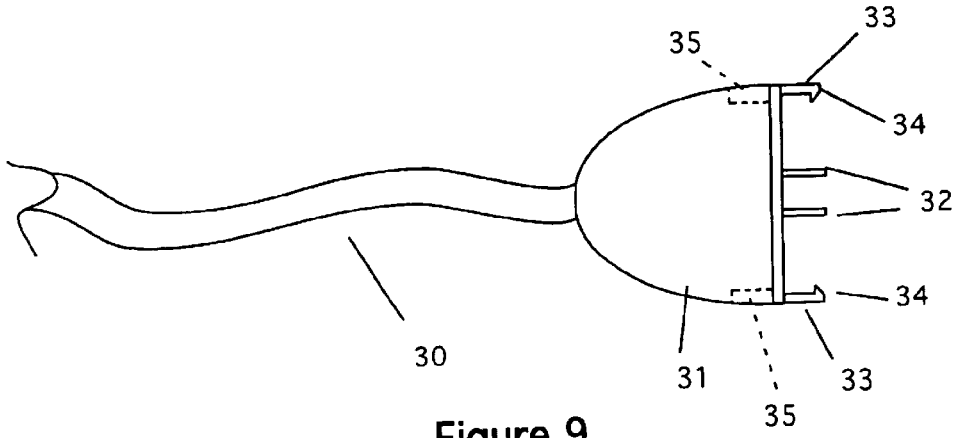
FIG. 9 is a top detail of a power cord that contains the safety removal system.

Once the replacement covers 10 are in use, power cords can be made with extra prongs as well. FIG. 9 is a top detail of a power cord that contains the safety removal system. Here, a power cord 30 has a plug head 31 that has a set of power prongs 32 and a pair of security prongs 33. As in the case of the removable caps, the security prongs have angled ends 34 that pass through the slots 12 and hold the plug 30 in place. The figure shows a plug having two prongs, however, the system can be used with three prong plugs as well.

Figure 10:
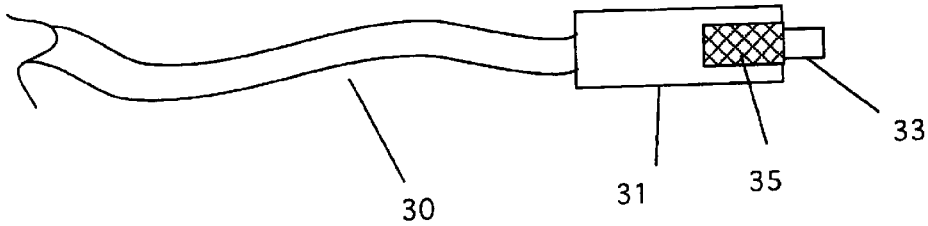
FIG. 10 is a side view of the power cord of FIG. 8 showing the release button.

FIG. 10 is a side view of the power cord 30 of FIG. 9 showing a release button 35. There are two buttons 35, one on each side of the plug 31. When the buttons are squeezed, they cause the prongs 33 to flex outward (see e.g., FIG. 8), which allows the hooked ends 34 to align with the slots 12.

In the preferred embodiment, the removable caps are made of molded plastic. However, and suitably strong and non-conductive material may be used as well.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A safety outlet cover system for an electrical receptacle having a first outlet and a second outlet, wherein each of said first and second outlets have a pair of slots formed therein, comprising:

a) a replacement outlet cover being generally rectangular, having a back a first outlet hole, and a second outlet hole formed therein, said first and second outlet holes being aligned in a linear orientation such that said first and second outlet holes conform to the orientation of said first and second outlets on said receptacle, wherein said replacement outlet cover also has a first pair of rectangular slots, having a straight, vertical orientation and being positioned adjacent to said first outlet hole, and a second pair of rectangular slots having a straight vertical orientation, and being positioned adjacent to said second outlet hole; and b) a removable cap, having a flat, solid face, said cap having a first pair of prongs attached thereto that conform to the rectangular slots on said first and second outlet on said receptacle, and a second pair of prongs, each of said second pair of prongs having a hooked end, whereby when said removable cap is aligned with said replacement outlet cover, said first pair of prongs aligns with one of said pairs of slots in said generally rectangular member, and further wherein when said removable cap is engaged with one of said pairs of slots, the hooked ends on said second pair of prongs pass through the one of said pair of rectangular slots such that the hooked ends engage the back of the generally rectangular member of said safety outlet cover, such that when said removable cap is in place over one of said first or second outlets, that outlet is completely covered by said removable cap.

2. The safety outlet cover system of claim 1 further comprising a means to release said pair of prongs from said replacement outlet cover.

3. The safety outlet cover system of claim 1 further comprising a means to release said pair of prongs from said replacement outlet cover comprise a pair of flexible members, extending outwardly from the flat, solid face of said removable cap, said pair of flexible members in alignment with said pair of prongs attached to said removable cap.

4. The safety outlet cover system of claim 1 further comprising a means to release said pair of prongs from said replacement outlet cover.

5. The safety outlet cover system of claim 4 wherein the means to release said pair of prongs from said replacement outlet cover comprise a pair of flexible members, extending outwardly from the flat, solid face of said removable cap, said pair of flexible members in alignment with said pair of prongs attached to said removable cap.

* * * * *